US007581813B2

(12) United States Patent
Okazaki et al.

(10) Patent No.: US 7,581,813 B2
(45) Date of Patent: Sep. 1, 2009

(54) INK-JET RECORDING APPARATUS

(75) Inventors: Naoya Okazaki, Gifu-ken (JP); Yoichiro Shimizu, Kasugai (JP); Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 445 days.

(21) Appl. No.: 11/390,358

(22) Filed: Mar. 28, 2006

(65) Prior Publication Data

US 2006/0221147 A1 Oct. 5, 2006

(30) Foreign Application Priority Data

Mar. 31, 2005 (JP) ..... 2005-100746
Sep. 15, 2005 (JP) ..... 2005-268068

(51) Int. Cl.
*B41J 23/00* (2006.01)
*B41J 2/17* (2006.01)
*B41J 2/175* (2006.01)

(52) U.S. Cl. ..... 347/37; 347/84; 347/85

(58) Field of Classification Search ..... 347/37, 347/84–85

See application file for complete search history.

(56) References Cited

U.S. PATENT DOCUMENTS

2003/0146958 A1 * 8/2003 Aruga et al. ..... 347/85
2004/0056934 A1 * 3/2004 Seino ..... 347/85

FOREIGN PATENT DOCUMENTS

JP 2004-268448 A 9/2004
JP 2004268448 A * 9/2004 ..... 347/85

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

An ink-jet recording apparatus includes a recording head, a carriage, an ink tank and a flexible ink supply member. The carriage is provided with an ink channel which supplies the recording head with ink that is supplied from the ink supply member and a valve body which controls the supply of ink to the recording head in the ink channel, the valve body being disposed so as to be movable in a movement direction of the carriage. In an ordinary state the valve body is urged relative to the ink channel so as to be located at a position where to restrict the supply of ink to the recording head. When the carriage is moved in such a direction that a positive ink pressure acts in a direction from the ink supply member to the recording head, the valve body is kept at the position due to inertia thereof.

10 Claims, 5 Drawing Sheets

INK-JET RECORDING APPARATUS

CROSS REFERENCE TO RELATED APPLICATION

This application claims priority from Japanese Patent Applications No. 2005-100746, filed on Mar. 31, 2005, and No. 2005-268068, filed on Sep. 15, 2005, the entire subject matter of which are incorporated herein by reference.

TECHNICAL FIELD

Aspects of the present invention relate to an ink-jet recording apparatus, particularly to an ink-jet recording apparatus in which a recording head is mounted on a carriage and which is equipped with a device for suppressing a phenomenon that the pressure of ink supplied to the recording head varies as the carriage is accelerated or decelerated.

BACKGROUND

Ink-jet recording apparatus in which a recording head is mounted on a carriage employ a tube supply method in which ink is supplied from an ink tank storing ink to the recording head via a flexible ink supply tube (ink tube).

In tube-supply-type ink-jet recording apparatus, recording is performed as the carriage mounted with the recording head is reciprocated along a guide rod. Therefore, the force of inertia acts on the ink in the ink tube as the carriage is accelerated or decelerated, as a result of which a pressure variation occurs in ink supplied to the recording head. This results in a problem that the pressure variation adversely affects the ink ejection performance of the recording head, which causes a variation in the ink ejection amount, variations in the manner of formation of ink droplets, and other undesirable phenomena, which in turn adversely affects the recording image quality.

One measure which is employed to solve the above problem is to absorb a pressure variation by changing the volume of a buffer room provided in part of an ink channel on the carriage by, for example, forming one side of the buffer room with a flexible film or storing air in the buffer room. JP-A-2004-268448 proposes a technique in which a communication hole is formed at the center of a movable valve. In an ordinary state, the communication hole is located at the same position as the ink channel to enable supply of ink to the recording head. While the carriage is accelerated or decelerated, the communication hole is deviated from the ink channel due to the inertia of the movable valve and the ink supply is thereby restricted.

SUMMARY

In the former technique in which the volume of the buffer room is changed, to enhance the pressure variation absorption effect, it is necessary to set the area of the flexible film large or to set the air volume larger than a prescribed value. This is problematic in miniaturizing the device.

In the latter technique in which the movable valve is moved in the carriage movement direction due to its inertia, a space is necessary which allows the movable valve to move in both of the right and left directions with respect to the communication hole as the carriage is reciprocated. This is also problematic in miniaturizing the device.

Aspects of the present invention provide an ink-jet recording apparatus capable of suppressing pressure variation of ink supplied to a recording head by means of a small and simple structure.

According to an aspect of the invention, there is provided an ink-jet recording apparatus including: a recording head which performs recording on a recording medium by ejecting ink droplets from ink ejection apertures; a carriage which is mounted with the recording head and is reciprocated; an ink tank which is provided outside the carriage and stores ink to be supplied to the recording head; and a flexible ink supply member which supplies ink from the ink tank toward the recording head, wherein the carriage is provided with an ink channel which supplies the recording head with ink that is supplied from the ink supply member and a valve body which controls the supply of ink to the recording head in the ink channel, the valve body being disposed so as to be movable in a movement direction of the carriage; in an ordinary state the valve body is urged relative to the ink channel so as to be located at a position where to restrict the supply of ink to the recording head; and when the carriage is moved in such a direction that a positive ink pressure acts in a direction from the ink supply member to the recording head, the valve body is kept at the position due to inertia thereof.

In the ink-jet recording apparatus, in an ordinary state the valve body is urged relative to the ink channel so as to be located at a position where to restrict the supply of ink to the recording head. When the carriage is moved in such a direction that a positive ink pressure acts in a direction from the ink supply member to the recording head, because of its inertia the valve body is kept at the position where to restrict the supply of ink. Therefore, the ink pressure is prevented from increasing in the recording head, whereby the ink ejection performance of the recording head is kept good and high-quality recording is enabled.

Since the recording head is given desired ink ejection performance even if the movement range of the valve body is small, the device can be made small.

BRIEF DESCRIPTION OF THE DRAWINGS

Illustrative aspects of the invention may be more readily described with reference to the accompanying drawings.

DETAILED DESCRIPTION

Figure 1:
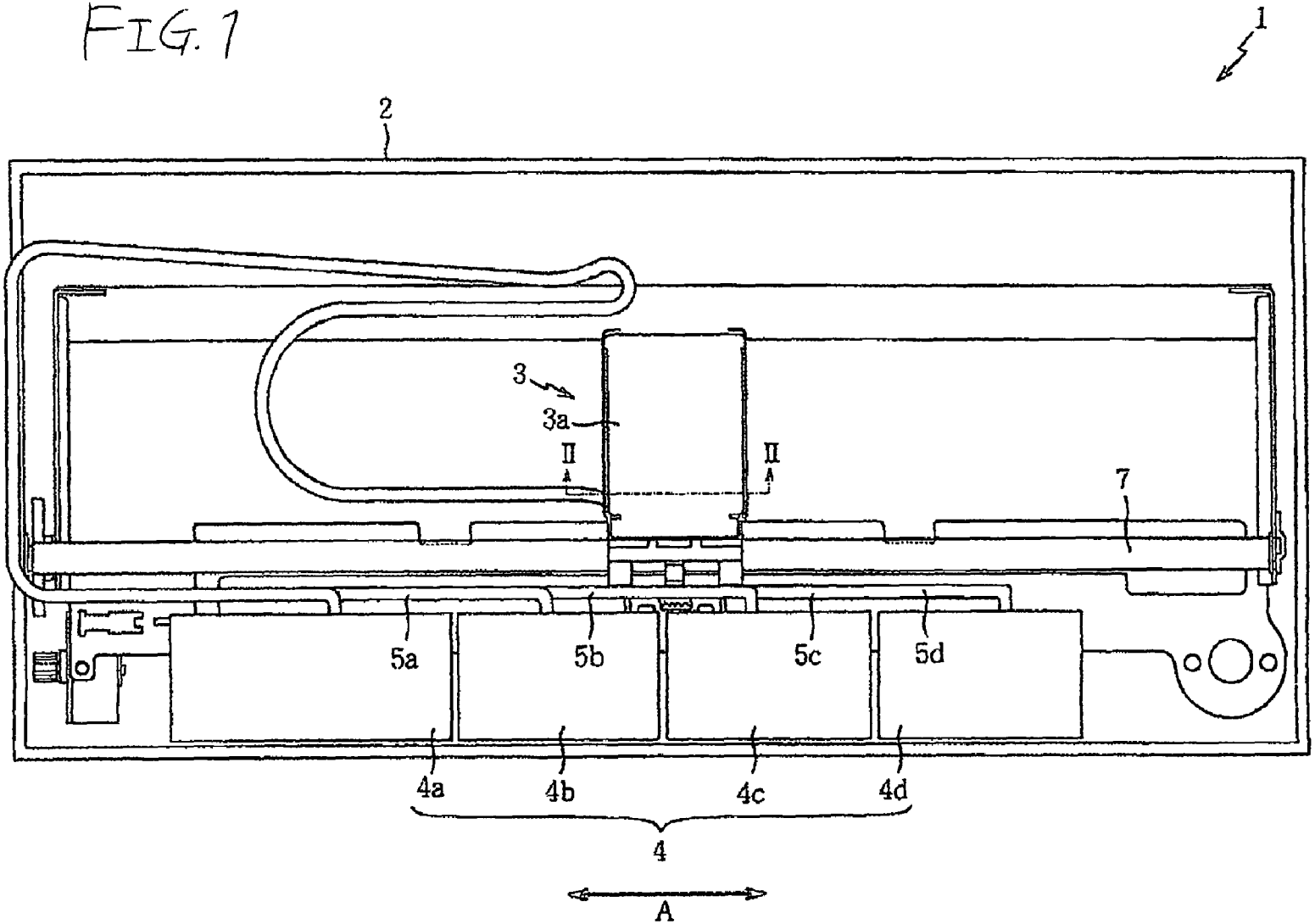
FIG. 1 is a plan view of an ink-jet recording apparatus according to an aspect of the present invention.

Aspects of the present invention will be hereinafter described with reference to the drawings. As shown in FIG. 1, an ink-jet recording apparatus 1 is equipped with a recording apparatus main body 2 which is generally box-shaped, a recording head unit 3 which is mounted inside the recording apparatus main body 2, ink tanks 4*a*-4*d*, and ink tubes 5*a*-5*d* (flexible ink supply members) for supplying inks from the ink tanks 4*a*-4*d* to the recording head unit 3.

The recording head unit 3 is mounted on a carriage 3*a*, and the carriage 3*a* is supported by a guide rod 7 so as to be movable in a direction A which is perpendicular to a recording medium transport direction. As is known, the carriage 3*a* is reciprocated across a recording medium by a belt which is driven by a motor.

The ink tanks 4, which are to store inks to be supplied to the respective recording heads, are disposed stationarily outside the carriage 3*a*, for example, under the recording medium transport path. The ink tanks 4 are four ink tanks 4*a*-4*d* which are arranged in the movement direction of the carriage 3*a* and contain black, yellow, cyan, and magenta inks, respectively. The ink tanks 4 supply inks to the recording head unit 3 via the respective ink tubes 5*a*-5*d*.

Figure 2:
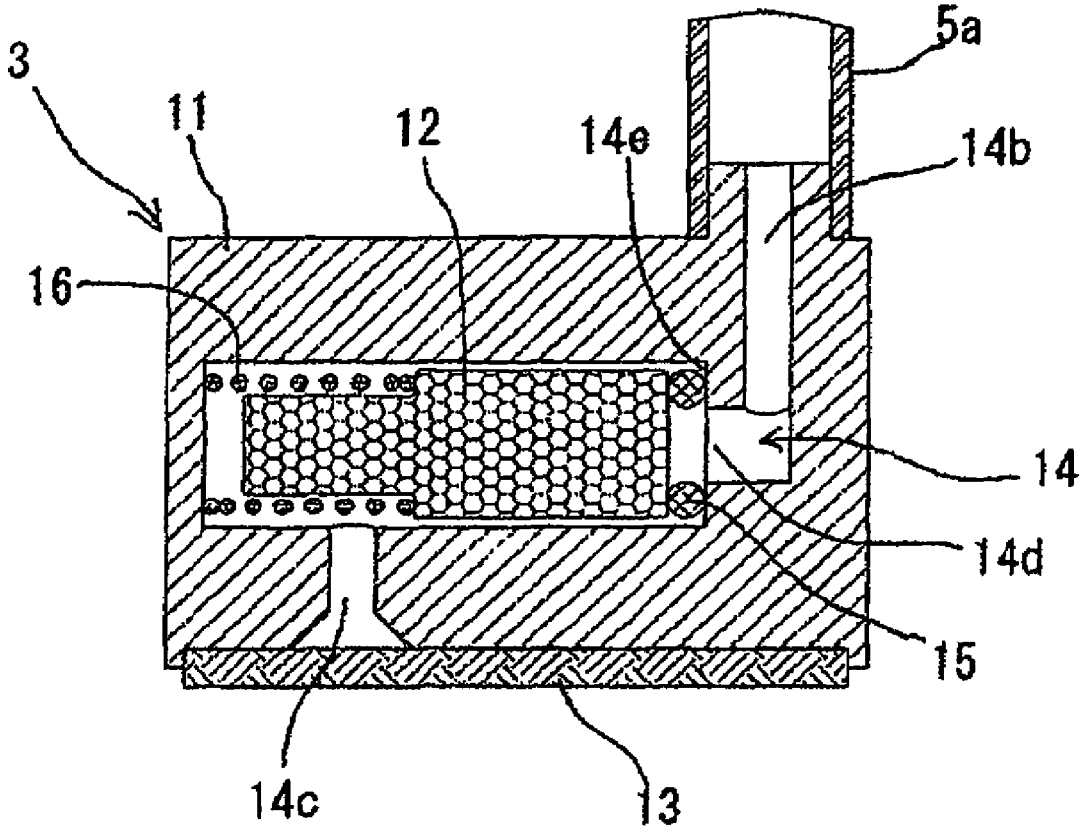
FIG. 2 is a sectional view of a recording head unit taken along line II-II in FIG. 1.

As shown in FIG. 2, the recording head unit 3 is equipped with a channel body 11 having ink channels 14 inside as well as with four recording heads 13 (only one of which is shown) which correspond to the above-mentioned inks of the four colors and are attached to the bottom surface, to be opposed to a recording medium, of the channel body 11. Each recording head 13 is the same in configuration as conventional ones in having plural pressure rooms (not shown) and plural ink ejection apertures (not shown) which correspond to the respective pressure rooms and are located at the bottom. Each recording head 13 ejects ink droplets downward from the ink ejection apertures when driven by pressure generating members such as piezoelectric elements or heating resistor elements.

Although the four ink channels 14 are arranged so as to correspond to the respective recording heads 13, only one ink channel 14 is shown in FIG. 2 because they have the same structure. The ink channel 14 is composed of a valve accommodation room 14*a* which is formed inside the channel body 11 and has a center axis extending parallel with the carriage movement direction, an introduction passage 14*b* which communicates with one end, in the center axis direction, of the valve accommodation room 14*a* via a valve opening 14*d*, and an output passage 14*c* which communicates with the valve accommodation room 14*a* at a position that is distant from the introduction passage 14*b* in the center axis direction. The output passage 14*c* communicates with the recording head 13 and supplies ink to it.

The introduction passage 14*b* communicates with the ink tank 4*a* via the ink tube 5*a*. As shown in FIG. 1, the ink tubes 5*a*-5*d* are led out of the carriage 3*a* in the carriage movement direction. The valve accommodation room 14*a* extends from the valve opening 14*d* in the same direction as (i.e., parallel with) the direction in which the 5*a*-5*d* are led out.

A valve body 12 is accommodated in the valve accommodation room 14*a* in such a manner that a gap that allows an ink flow is formed outside the outer circumferential surface of the valve body 12, whereby the valve body 12 is movable in the center axis direction. The valve body 12 is always urged in the center axis direction by a spring 16 which is accommodated in the valve accommodation room 14*a*. In an ordinary state, the valve body 12 is in contact with a valve-opening-14*d*-side wall surface 14*e* of the valve accommodation room 14*a* via a sealing member 15 and thereby closes the valve opening 14*d*. The sealing member 15 is inserted between the valve body 12 and the wall surface 14*e* of the valve accommodation room 14*a*.

Figure 3:
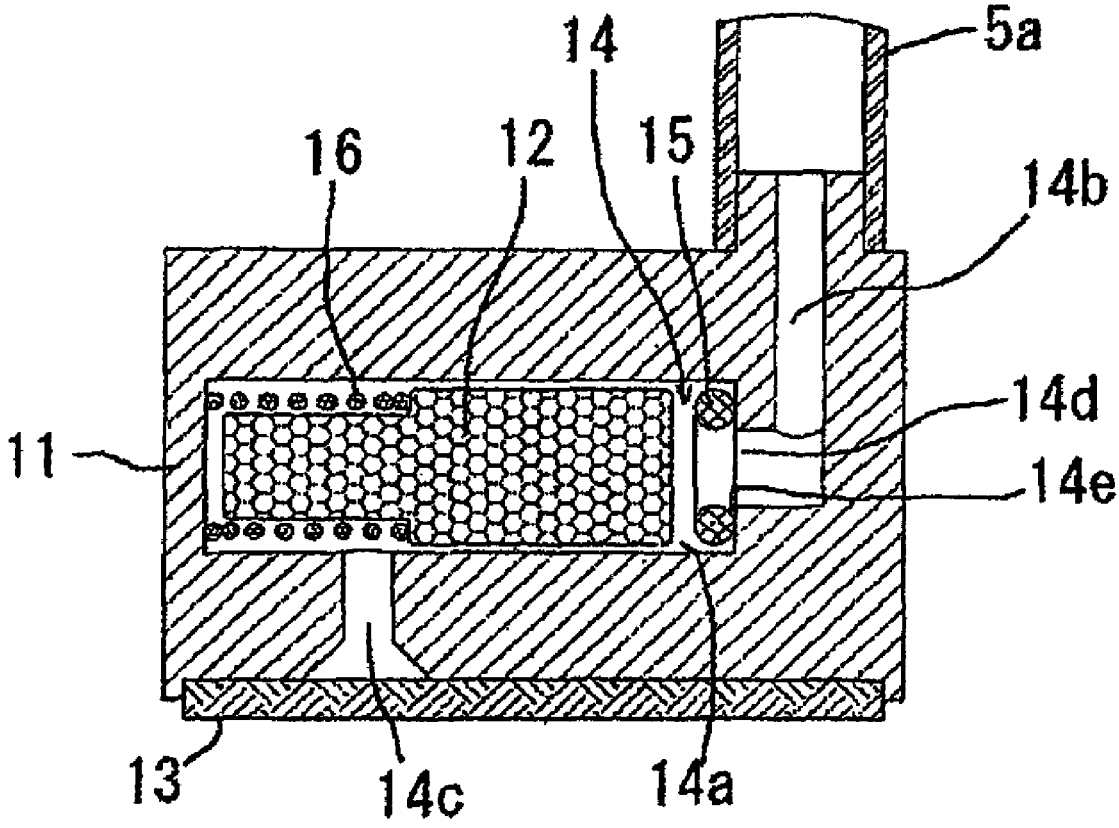
FIG. 3 is a view corresponding to FIG. 2 and illustrating an operation.

Made of a material whose specific gravity is higher than the ink to be filled into the ink channel 14, the valve body 12 receives force of inertia because of its own weight as the carriage 3*a* is moved. When the ink in the valve accommodation room 14*a* is consumed by ejection of ink droplets from the recording head 13 and the pressure of the space in the valve accommodation room 14*a* thereby becomes lower than a prescribed value, as shown in FIG. 3 the valve body 12 is moved against the urging force of the spring 16, whereby the valve opening 14*d* is opened and ink is supplied from the ink tank 4*a*. The pressure in the valve accommodation room 14*a* is kept constant in this manner. The urging force of the spring 16 is set so that the pressure of ink that is supplied from the valve accommodation room 14*a* to the recording head 13 becomes an approximately constant negative pressure (what is called a back pressure) that is lower than atmospheric pressure.

While the carriage 3*a* is stopped or is being moved at a constant speed, the valve body 12 closes the valve opening 14*d* due to the urging force of the spring 16. When the carriage 3*a* is accelerated leftward in FIG. 1, that is, in the direction in which the tube 5*a* is led out, the ink in the tube 5*a* flows toward the carriage 3*a* because of its inertia and thereby increases the pressure in the introduction passage 14*b*.

Although at this time the recording head unit 3 is also accelerated leftward in FIG. 2, the valve body 12 is pushed strongly toward the valve opening 14*d* because of its inertia and thereby prevents the high-pressure ink in the introduction passage 14*b* from flowing into the recording head 13. As a result, the pressure of the ink in the recording head 13 is prevented from increasing and, instead, kept almost constant. The ink ejection performance of the recording head 13 is kept good and high-quality recording is enabled.

When the carriage 3*a* is accelerated rightward in FIG. 1, that is, in the direction opposite to the direction in which the tube 5*a* is led out, the ink in the tube 5*a* flows away from the carriage 3*a* because of its inertia and thereby decreases the pressure in the introduction passage 14*b*, that is, produces a negative pressure. As shown in FIG. 3, the valve body 12 moves away from the valve opening 14*d*, that is, moves in such a direction as to open the valve opening 14*d*. If at this time a large amount of ink has been ejected from the recording head 13 and hence the pressure in the recording head 13 has been lowered, supply of ink to the recording head 13 is permitted. The ink ejection performance of the recording head 13 is kept good and high-quality recording is enabled.

When ink droplets are ejected to prevent clogging of the recording head 13 in a state that the carriage 3*a* is stopped or to perform recording on a recording medium in a state that the carriage 3*a* is making a constant speed movement, as described above the ink in the valve accommodation room 14*a* is consumed by the ejection of ink droplets from the recording head 13 and the pressure of the space in the valve accommodation room 14*a* is thereby lowered. As shown in FIG. 3, the valve body 12 is moved against the urging force of the spring 16, whereby the valve opening 14*d* is opened and ink is supplied from the ink tank 4*a*. The pressure in the valve accommodation room 14*a* is kept constant in this manner, and the ink discharge performance of the recording head 13 is kept good.

Figure 4:
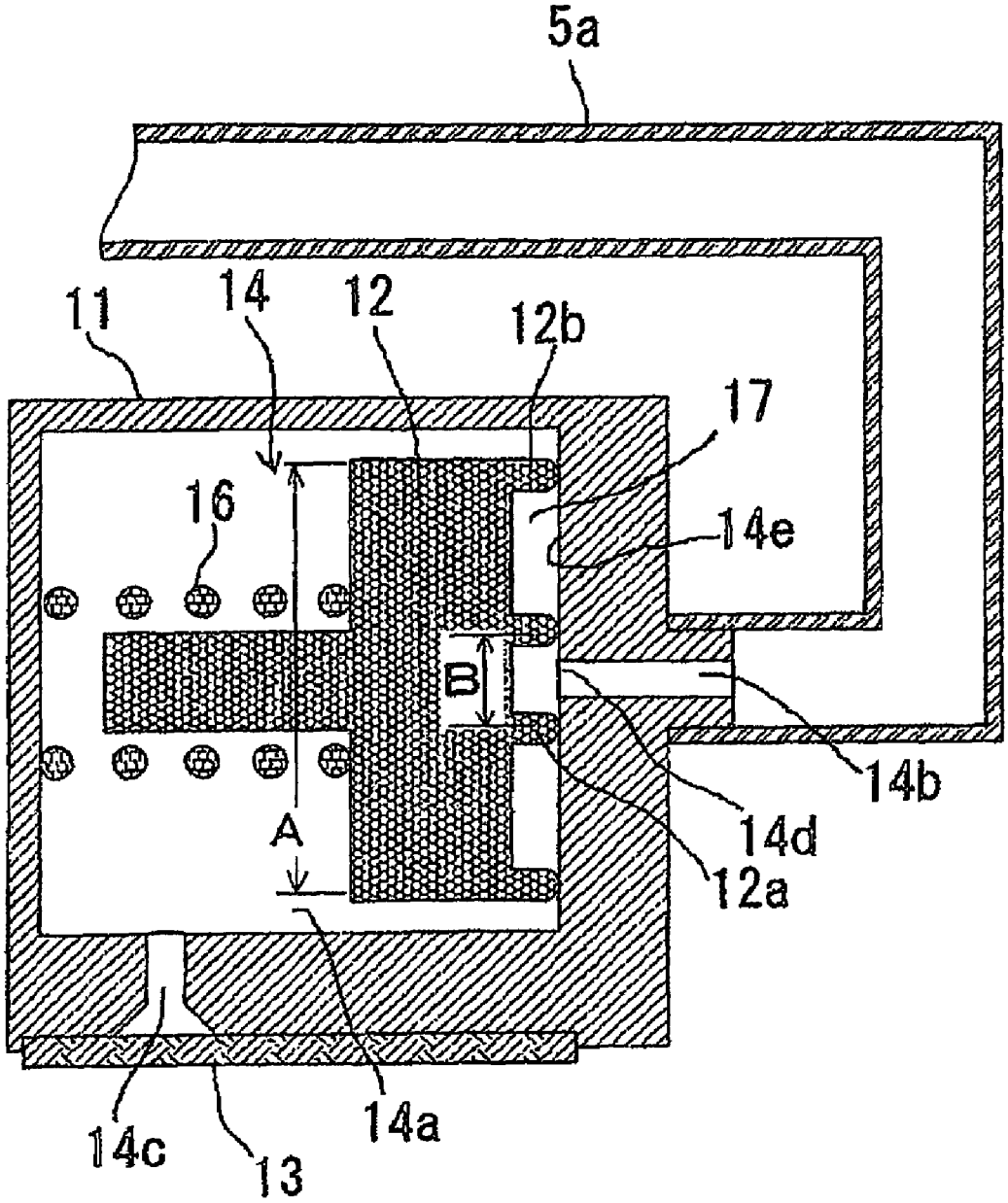
FIG. 4 is a sectional view of a recording head unit according to another aspect.

FIG. 4 shows another aspect. Members having corresponding members in the above aspect are given the same reference symbols as the latter and will not be described below. A valve accommodation room 14*a* and a valve body 12 of this aspect are oriented in the same manner with respect to the carriage movement direction as in the above aspect.

In this aspect, a surface of the valve body 12 which is opposed to a valve-opening-14*d*-side wall surface 14*e* of the valve accommodation room 14*a* has double ribs 12*a* and 12*b* which are like concentric rings and project toward the wall surface 14*e*. The ribs 12*a* and 12*b* have rubber-like elasticity and also serve as sealing members when they are brought into contact with the wall surface 14*e* of the valve accommodation room 14*a* by the urging force of the spring 16. The inside rib 12*a* comes into contact with the wall surface 14*e* of the valve accommodation room 14*a* so as to surround the valve opening 14*d*. The outside rib 12*b* comes into contact with the wall surface 14*e* of the valve accommodation room 14*a* so as to be spaced from the inside rib 12*a* in the radial direction. In a state that the inside and outside ribs 12*a* and 12*b* are in contact with the wall surface 14*e*, a closed space 17 is formed between the ribs 12*a* and 12*b* so as to be independent of the valve opening 14*d* and the valve accommodation room 14*a*.

Therefore, between an area B, which is on the inner side of a location at which the inside rib 12*a* abuts on the wall surface 14*e*, and an area A, which is on the inner side of a location at which the outside rib 12*b* abuts on the wall surface 14*e*, the following relationship is established: A>B. On the area B of the valve body 12 that is orthogonal to the opening direction (moving direction) thereof, the pressure of ink acts in the direction of opening the valve body 12 from the valve opening 14*d*. Also, when the pressure of the valve accommodation room 14*a* decreases as ink therein is consumed, the pressure of ink acts on the area A as well in the direction of opening the valve body 12. That pressure is exerted on the area A from the inner side of the accommodation room 14*a*. Since the area A is larger than the area B, the valve body 12 is easily opened against the urging force of the spring 16 in response to the pressure variation within the valve accommodation room 14*a*.

Since the valve accommodation room 14*a* is filled with ink, the space 17 between the ribs 12*a* and 12*b* is filled with ink even in a state that the valve body 12 is in contact with the wall surface 14*e* of the valve accommodation room 14*a*. The pressure of the ink in the space 17 is equal to a pressure that the valve accommodation room 14*a* had immediately before the contact of the valve body 12 to the wall surface 14*e* of the valve accommodation room 14*a*. That is, when the valve opening 14*d* is opened, the pressure of the ink in the tube 5*a* acts on the valve body 12 and hence the pressure of the ink in the space 17 becomes approximately equal to the pressure of the ink in the tube 5*a*, that is, atmospheric pressure. After the valve opening 14*d* is closed by the valve body 12, the pressure in the valve accommodation room 14*a* is lowered as ink droplets are ejected. Therefore, the pressure of the ink in the space 17 becomes higher than the pressure in the valve accommodation room 14*a*.

The pressure of the ink confined in the space 17 acts in such a direction as to open the valve opening 14*d* together with the pressure due to the difference between the areas A and B. Therefore, the urging force of the spring 16 for urging the valve body 12 toward the position where the valve body 12 is to close the valve opening 14*d* can be made weaker (than in the case where the measure of confining ink in the space 17 is not taken). As a result, the speed of the response of the valve body 12 to a pressure variation in the valve accommodation room 14*a* can be increased. The pressure variation in the recording head 13 can be reduced and its ink discharge performance can be kept almost constant.

As in the above aspect, the valve body 12 of this aspect is provided so as to be movable in the scanning direction of the recording head 13. Therefore, the ink pressure variation due to the scanning by the recording head 13 can be suppressed. The space 17 between the ribs 12*a* and 12*b* may be formed in the wall surface 13*e*, opposed to the valve body 12, of the valve accommodation room 14*a* instead of the valve body 12.

Incidentally, the space 17 between the ribs 12*a* and 12*b* may be eliminated, and the valve body 12 may be made to be responsive to the pressure variation only by the pressure due to the difference between areas A and B.

Figure 5:
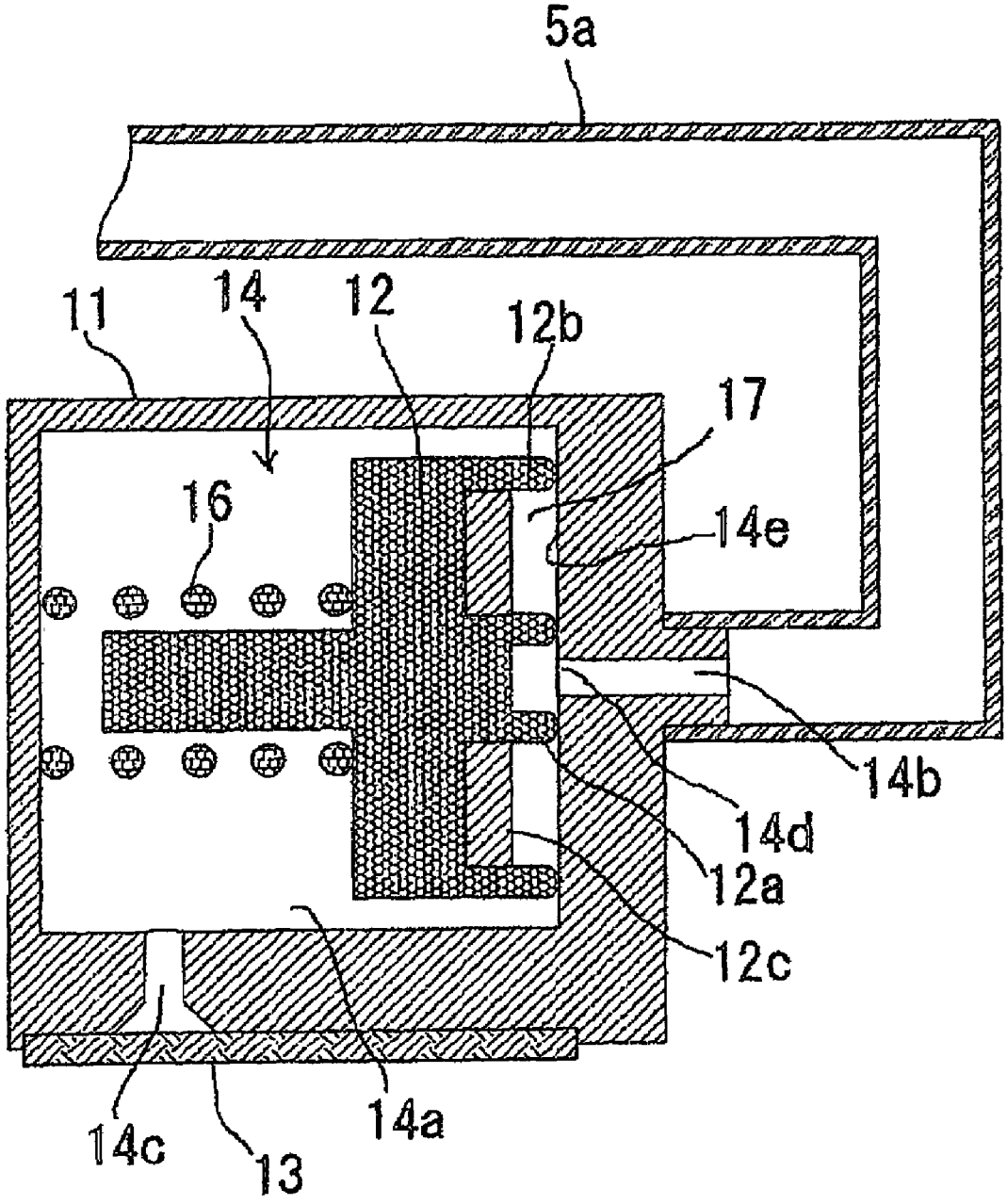
FIG. 5 is a sectional view of a recording head unit according to still another aspect of the present invention.

FIG. 5 shows a still further aspect of the invention. Members having corresponding members in the aspect shown in FIG. 4 are given the same reference symbols as the latter and will not be described below. A valve accommodation room 14*a* and a valve body 12 of this aspect are oriented in the same manner with respect to the carriage movement direction as in the above aspect.

The valve body 12 of this aspect has substantially the same shape as that of the aspect shown in FIG. 4, however, an ring-shaped mass body 12*c* is embedded on the bottom of the ring-shaped space 17 between the ribs 12*a*, 12*b*. The mass body 12*c* makes the valve body 12 heavier than that of the above aspect, and has the specific gravity heavier than that of the ink or rubber. Preferably, the mass body is made of metal such as iron.

When the carriage 3*a* is accelerated in a direction in which the ink within the tube 5*a* flows into the valve opening 14*d* with positive pressure, the valve body 12 also presses the wall surface 14*e* due to the inertia of the mass body 12*c*. Thus, even when a large positive pressure of the ink from the valve opening 14*d* acts on the valve body 12, the valve body rigidly maintains the closed state of the valve opening 14*d*. Therefore, the pressure variation within the valve accommodation room 14*a* is suppressed.

Although the above two aspects are such that in an ordinary state the valve opening 14*d* is closed completely by the valve body 12, a modification is possible in which even in a closed state a very narrow channel is left so that ink can be supplied at a very low rate with a large channel resistance.

As was described, according to the aspects of the invention, when the carriage 3*a* is moved in such a direction that a negative ink pressure acts in a direction from the ink supply member to the recording head 13, because of its inertia the valve body 12 is moved, against the urging, to a position where to permit the supply of ink. If at this time a large amount of ink has been ejected from the recording head 13 and hence the pressure in the recording head 13 has been lowered, ink is easily supplied to the recording head 13. Therefore, the ink ejection performance of the recording head 13 is kept good and high-quality recording is enabled.

Further, in an ordinary state the valve body 12 is urged in such a direction as to close the ink channel. When a negative pressure is produced at a position, closer to the recording head 13 than the valve body 12 is, in the ink channel due to ejection of ink droplets from the recording head 13, the valve body 12 is moved, against the urging, to a position where to open the ink channel. When the pressure in the recording head 13 is lowered due to ejection of ink droplets from the recording head 13, ink is supplied to the recording head 13 and the pressure in the recording head 13 is kept almost constant. High-quality recording is thereby enabled. Further, since the above advantage is obtained by the valve body's moving from the closing position to the opening position, the movement range of the valve body 12 can be small and hence the device can be made small.

The ink channel has a valve opening 14*d* which opens to the movement direction of the carriage, and the valve body 12 can be moved in the movement direction of the carriage 3*a* so as to come close to and go away from the valve opening 14*d*. As the carriage 3*a* is moved, because of its inertia the valve body 12 comes close to or goes away from the valve opening 14*d* to restrict or permit the supply of ink. As a result, the pressure variation of ink in the recording head 13 can be reduced and high-quality recording is enabled.

The ink channel has a valve accommodation room 14*a* which accommodates the valve body 12 in such a manner that the valve body 12 is movable in the movement direction of the carriage 3*a*, the valve opening 14*d* is provided at one end of the valve accommodation room 14*a*, and the valve accommodation room is communicated with the recording head 13. As the carriage 3*a* is moved, because of its inertia the valve body

12 easily comes close to or goes away from the valve opening 14*d* to restrict or permit the supply of ink, whereby the pressure variation of ink in the recording head 13 can be reduced. Further, since the valve body 12 is accommodated in the valve accommodation room 14*a*, the device can be made small.

The carriage 3*a* is provided with a channel body having the ink channel inside, and the recording head 13 is fixed to the channel body. The device can thus be made small.

The ink supply member is led out of the carriage 3*a* in the movement direction of the carriage, the valve body 12 is kept at the position where to restrict the supply of ink when the carriage is moved in the direction in which the ink supply member is led out, and the valve body 12 is moved to a position where to permit the supply of ink when the carriage 3*a* is moved in a direction opposite to the direction in which the ink supply member is led out. Even if the ink in the ink supply member which is led out of the carriage 3*a* is moved because of its inertia as the carriage is moved, the action of the valve body 12 effectively suppresses pressure variation in the recording head. High-quality recording is thus enabled.

What is claimed is:

1. An ink-jet recording apparatus comprising:

a recording head which performs recording on a recording medium by ejecting ink droplets from ink ejection apertures;

a carriage which is mounted with the recording head and is reciprocated;

an ink tank which is provided outside the carriage and stores ink to be supplied to the recording head; and a flexible ink supply member which supplies ink from the ink tank toward the recording head, wherein the carriage is provided with an ink channel which supplies the recording head with ink that is supplied from the ink supply member and a valve body which controls the supply of ink to the recording head in the ink channel, the valve body being disposed so as to be movable in a movement direction of the carriage;

wherein in an ordinary state the valve body is urged relative to the ink channel so as to be located at a position that restricts the supply of ink to the recording head; and wherein when the carriage is moved in a direction, such that a positive ink pressure acts in a direction from the ink supply member to the recording head, inertia of the valve body is directed to the position that restricts the supply of ink to the recording head.

2. The ink-jet recording apparatus according to claim 1, wherein when the carriage is moved in such a direction that a negative ink pressure acts in a direction from the ink supply member to the recording head, the valve body is moved due to the inertia of the valve body, against the urging, to a position that permits the supply of ink.

3. The ink-jet recording apparatus according to claim 1, wherein in the ordinary state the valve body is urged in such a direction as to close the ink channel, and when a negative pressure is produced at a position, closer to the recording head than the valve body is, in the ink channel due to ejection of ink droplets from the recording head, the valve body is moved, against the urging, to a position that opens the ink channel.

4. The ink-jet recording apparatus according to claim 1, wherein the ink channel has a valve opening which opens to the movement direction of the carriage, and the valve body can be moved in the movement direction of the carriage so as to come close to and go away from the valve opening.

5. The ink-jet recording apparatus according to claim 4, wherein the ink channel has a valve accommodation room which accommodates the valve body in such a manner that the valve body is movable in the movement direction of the carriage, the valve opening is provided at one end of the valve accommodation room, and the valve accommodation room is communicated with the recording head.

6. The ink-jet recording apparatus according to claim 1, wherein the carriage is provided with a channel body having the ink channel inside, and the recording head is fixed to the channel body.

7. The ink-jet recording apparatus according to claim 1, wherein the ink supply member is led out of the carriage in the movement direction of the carriage;

wherein the valve body is kept at the position that restricts the supply of ink when the carriage is moved in the direction in which the ink supply member is led out; and wherein the valve body is moved to a position that permits the supply of ink when the carriage is moved in a direction opposite to the direction in which the ink supply member is led out.

8. The ink-jet recording apparatus according to claim 1, wherein a specific gravity of the valve body is higher than that of the ink to be supplied.

9. An ink-jet recording apparatus comprising:

an ink-jet recording head;

an ink tank which stores ink to be supplied to the recording head;

a flexible ink supply member which supplies ink from the ink tank to the ink-jet recording head;

a carriage which reciprocates the ink-jet recording head, the carriage comprising;

an ink-jet recording head;

an ink channel which conveys ink from the flexible ink supply member to the ink-jet recording head; and a valve body which is disposed in the ink channel so as to be movable in a direction of reciprocation of the carriage and which has a specific gravity higher than that of the ink; and a spring member which urges the valve body into a restrictive position which restricts a supply of ink to the ink-jet recording head, wherein in an ordinary state, the valve body is urged by the spring member into the restrictive position, and wherein when the carriage is moved during reciprocation, the valve body opens and closes based on an inertia of the valve body, and when the carriage is moved in a direction such that a positive ink pressure acts in a direction from the ink supply member to the ink-jet recording head, the valve body is maintained in the closed position due to the inertia of the valve body.

10. The ink-jet recording apparatus according to claim 9, wherein when the carriage is moved in a direction such that a negative pressure acts in the direction from the ink supply member to the ink-jet recording head, the valve body is moved, due to the inertia of the valve body, against the urging of the spring member to a position permitting the supply of ink.

* * * * *